US006171022B1

(12) United States Patent
Decker

(10) Patent No.: US 6,171,022 B1
(45) Date of Patent: Jan. 9, 2001

(54) METHOD OF ATTACHING MAT FOR CONTROLLING EROSION

(76) Inventor: Stephen W. Decker, W9279 Ripley Rd., Cambridge, WI (US) 53523

( * ) Notice: Under 35 U.S.C. 154(b), the term of this patent shall be extended for 0 days.

(21) Appl. No.: 09/286,306

(22) Filed: Apr. 5, 1999

(51) Int. Cl.[7] ..... E02B 3/12

(52) U.S. Cl. ..... 405/16; 405/15; 405/19; 405/244; 52/155

(58) Field of Search ..... 405/15, 16, 19, 405/244; 52/155, 162

(56) References Cited

U.S. PATENT DOCUMENTS

| | | | | |
|---|---|---|---|---|
| 360,225 | * | 3/1887 | Kanters | 405/19 |
| 457,818 | * | 8/1891 | Nier | 405/19 |
| 660,667 | * | 10/1900 | Swartz | 405/244 |
| 825,996 | * | 7/1906 | Whitney | 405/19 |
| 1,026,616 | * | 5/1912 | Stratton | 405/16 |
| 1,028,123 | * | 6/1912 | McGreevey | 405/244 |
| 2,047,197 | * | 7/1936 | Fordyce | 405/19 |
| 3,279,301 | * | 10/1966 | Fisher | 29/522.1 |
| 3,716,998 | * | 2/1973 | Lerche-Svendsen et al. | 405/19 |
| 4,135,843 | * | 1/1979 | Umemoto et al. | 405/18 |
| 4,472,086 | * | 9/1984 | Leach | 405/258 |
| 4,592,675 | * | 6/1986 | Scales et al. | 405/19 |
| 4,993,870 | * | 2/1991 | Bridgewater | 405/21 |
| 5,249,893 | * | 10/1993 | Romanek et al. | 405/258 |
| 5,257,878 | * | 11/1993 | Peterson | 405/15 |
| 5,322,386 | * | 6/1994 | Trangsrud | 405/19 |
| 5,358,356 | * | 10/1994 | Romanek et al. | 405/16 |
| 5,429,450 | * | 7/1995 | meidinger | 405/15 |

FOREIGN PATENT DOCUMENTS

| | | | | |
|---|---|---|---|---|
| 4220746 | * | 1/1994 | (DE) | 405/15 |
| 2596436 | * | 10/1987 | (FR) | 405/24 |
| 133928 | * | 8/1982 | (JP) | 405/258 |
| 89728 | * | 4/1988 | (JP) | 405/15 |

* cited by examiner

*Primary Examiner*—Eileen D. Lillis
*Assistant Examiner*—Alexandra K. Pechhold
(74) *Attorney, Agent, or Firm*—Kajane McManus

(57) ABSTRACT

The method for engaging a geosynthetic or erosion mat including a soil engaging layer to underlying ground includes the steps of feeding a length of twine out over the soil engaging layer of the mat, and pressing a loop of the twine into the ground at intermittent points therealong. If required, an enhancing step of compressing the ground over the pressed in twine may be incorporated into the method.

15 Claims, 2 Drawing Sheets

METHOD OF ATTACHING MAT FOR CONTROLLING EROSION

BACKGROUND OF THE INVENTION

1. Field of the Invention

The present invention discloses a method of attaching a geosynthetic or erosion mat (hereinafter "mat") to the ground. More particularly, the method teaches the use of a suitable twine, which may or may not be biodegradable, for engaging the mat to the ground in a manner similar to sewing.

2. Prior Art

Heretofore, various methods of attaching an erosion control mat to underlying ground have been proposed.

These have typically included the use of metal stakes, clips, or staples which are necessarily driven into the ground through the mat at points along the mat, to secure the mat in place upon the underlying ground.

Obviously such methods are labor intensive and therefore time consuming. Further, the material of the attachment devices has not been capable of being biodegradable because of the type of stresses placed thereon during installation.

SUMMARY OF THE INVENTION

Accordingly it is a primary object of the invention to provide a method for attaching a geosynthetic or erosion mat which is less labor intensive.

Further it is an object to provide a less concussive method allowing for use of biodegradable material in creating the attachment, if desired.

These as well as other objects are met by the mat attachment method of the present invention wherein a length of twine is fed or played out over the mat with a loop of the twine being pressed through the mat into the ground at intermittent points along the mat, with lengths of the twine between the intermittent pressed in points overlying the mat, substantially sewing the mat to the ground. Further, if necessary, the ground may be compacted around the loops of twine pressed thereinto.

DESCRIPTION OF THE PREFERRED EMBODIMENTS

Figure 6:
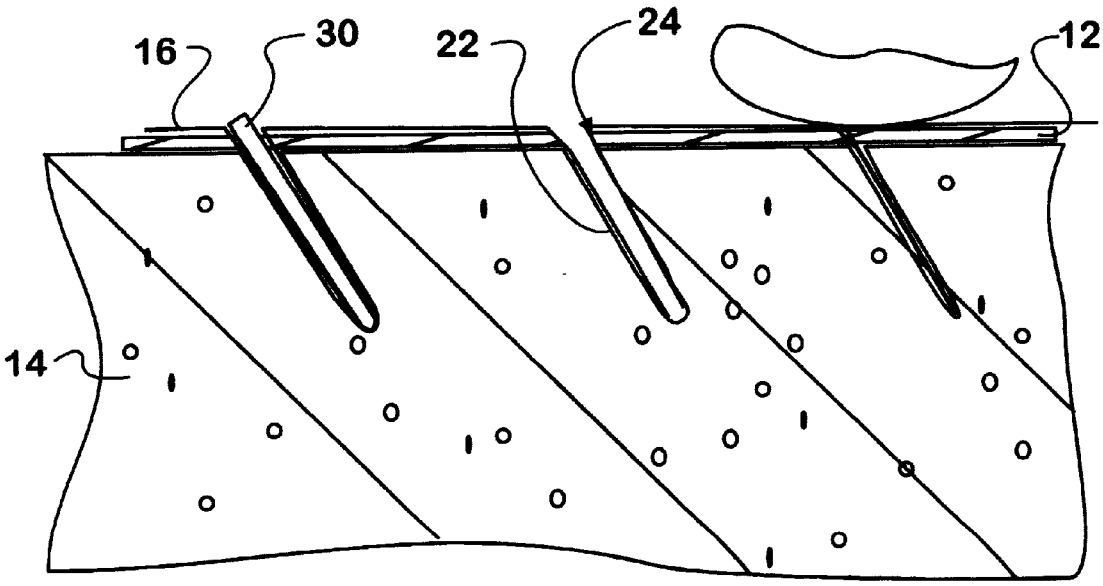
FIG. 6 is a view similar to FIG. 1 and shows a further orientation for the loop of twine as well as an enhancement to the method of compacting the ground about the loop of twine pressed thereinto.
Figure 1:
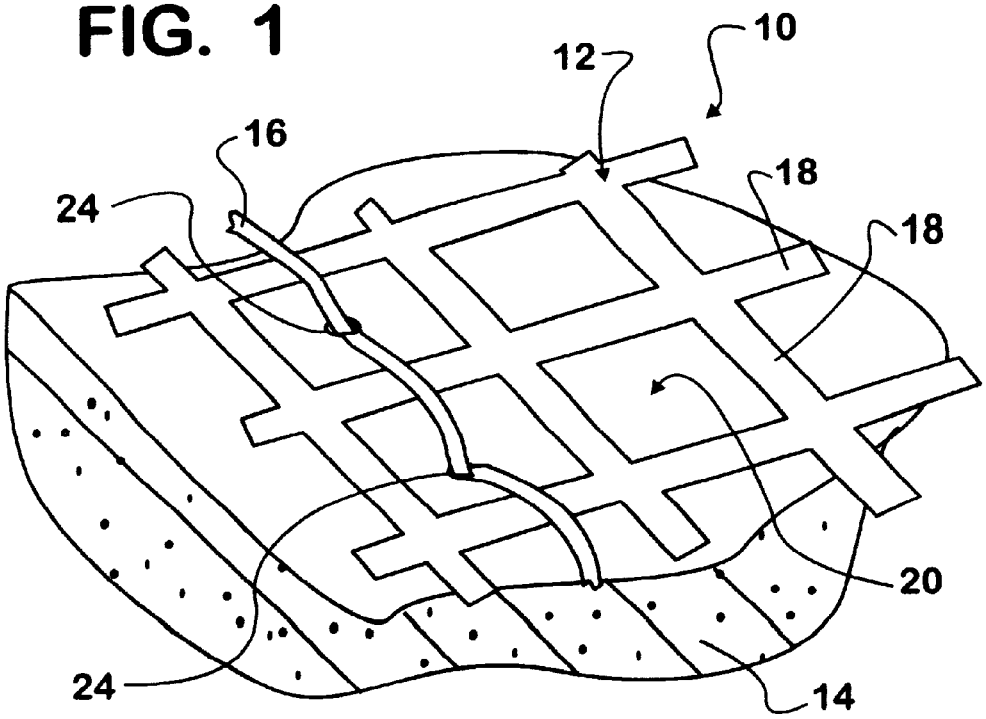
FIG. 1 is a perspective view of an area of ground covered by a geosynthetic or erosion control mat showing the mat fixed to the ground by twine as taught by the method of the present invention.

Referring now to the drawings in greater detail there is illustrated therein a method for attaching a geosynthetic or erosion control mat 10 comprising at least one soil engaging layer 12, which may be made of a plastic net or bionet material, to underlying ground 14 using a length of twine 16 which, when acted upon in accordance with the method disclosed herein, secures the mat 10 in place.

The single soil engaging layer 12 shown here is seen to comprise a lattice 12, one of the more popular embodiments, though this should not be construed as limiting.

The lattice 12 is seen to comprise criss crossed links 18 of a geotechnical material which may be completely biodegradable or which may include biogradable components, if necessary or desired.

Spaces 20 are interspersed within the spaced apart criss cross pattern of the material links 18 intermittently across the expanse of the lattice 12.

When the soil engaging layer 12 comprises such lattice 12 configuration, the method of the present invention takes advantage of the spaces 20 for engaging the layer 12 to the ground 14 therebeneath.

In this respect, as illustrated, a length of twine 16 is shown extending between adjacent spaces 20, across a single link 18 of the layer 12, with loops 22 (FIGS. 2–6) of twine 16 at intermittent points 24, being pressed into the ground 14 underlying the layer 12.

The twine 16 which is exposed between the intermittent points 24 serves to secure the layer 12 to the ground 14 by its tautness across the layer 12.

It will be understood, of course, that the length of twine 16 could be continuous across the extent of the soil engaging layer 12 or could be continuous between adjacent points 24, such choice being discretionary.

As stated above, various forms of geosynthetic material comprising the layer 12 do not provide spaces 20 therein, and in such an instance, loops 22 of the twine 16 would simply be pressed through the material of the layer 12, into the ground 14 by use of a suitable tool 30 which could accommodate such action, as best illustrated in FIGS. 2–5.

FIGS. 2–5 illustrate the steps of the method and provide an illustration of one embodiment of a tool 30 which would be functional in the method.

Figure 2:
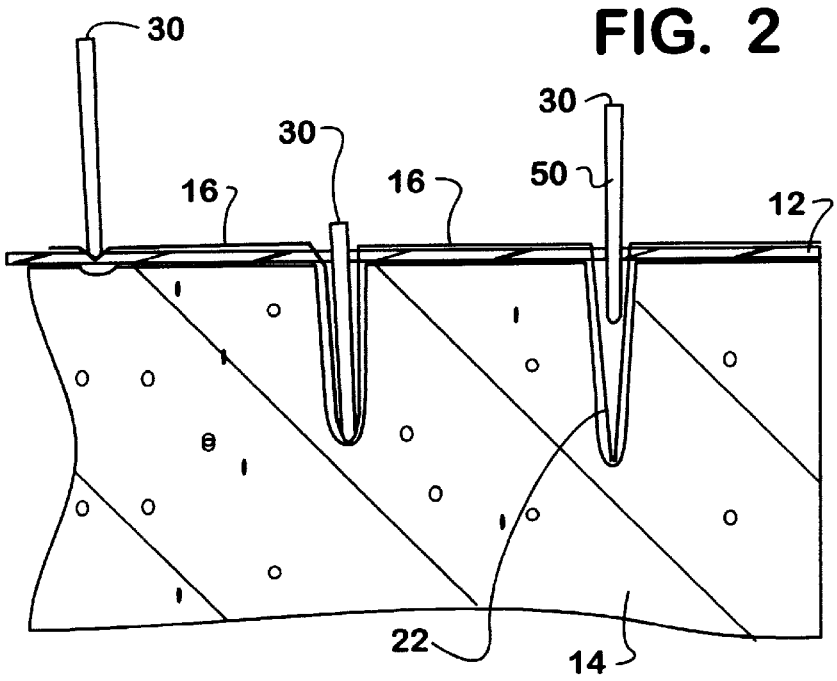
FIG. 2 is a side view showing an exemplary tool in various pressed in positions thereof, releasably engaging the twine and the mat underlying the twine and overlying an area of ground therebeneath.
Figure 3:
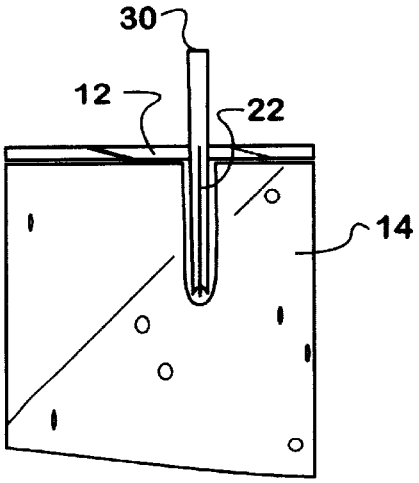
FIG. 3 is a side view showing the tool depressed partly into the ground, and shows a notch at a distal end of the tool configured to releasably engage the twine therewithin.
Figure 4:
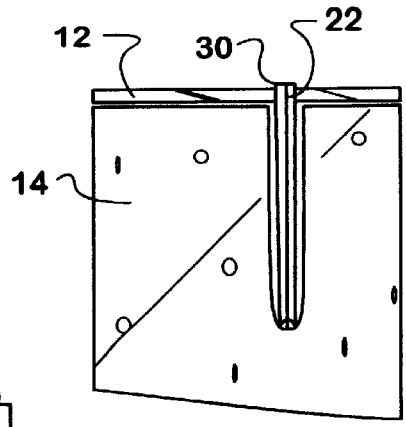
FIG. 4 is similar to FIG. 3 but shows the tool maximally depressed.
Figure 5:
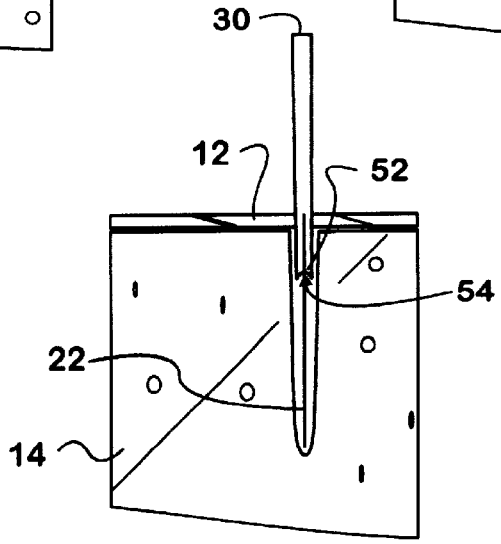
FIG. 5 is similar to FIG. 4 but shows the tool being extracted from the ground, with a loop of twine remaining pressed into the ground.

Beginning with FIG. 2, it will be understood that the length of twine 16 would be played out over a region of the layer 12 where it is desired to provide engagement of the layer 12 to the underlying ground 14. It will be understood, of course, that engagement using the method could also be accomplished in an area of abutment between two sections of mat 10 where exposed edge areas of the layer 12 of each of the two sections would overlap.

As the length of twine 16 is played out, at intermittent points 24 along the layer 12, the twine 16 is engaged by the tool 30 and the loop 22 of the twine 16, as defined by the tool 30 as the tool 30 is pressed into the ground 14, is effectively buried in the ground 14 by the tool 30, and remains in the ground 14 upon retraction of the tool 30.

It will be seen from the Figures that the tool 30 may be pressed into the ground 14 vertically or angularly. The benefit of the angulation will become apparent upon considering the varied soil types of ground 14 upon which the mat 10 is to be laid.

For example, in a sand environment, vertical action could be appropriate inasmuch as sand will quickly fill the void created by the tool 30 upon retraction thereof, fixing the twine loop 22 in place therewithin.

On the other hand, where the ground 14 is perhaps made of coarse clay particles, it may be preferable to create an angulated void so that the coarser particles can more easily fill in a void that is substantially shorter in the vertical extent thereof.

Further, an environment wherein backfilling of the void does not take place of its own accord may be encountered, such as when working in rocky ground 14. In this instance, the method offers a further step to assure secure engagement of the loop 22 of twine 16 within the ground 14. Here, as best illustrated in FIG. 6 in generic form, tamping or compressing of the ground 14 over the loop 22 of twine 16 may be added as an enhancing step after extraction of the tool 30 has taken place.

Such compression may be accomplished in any suitable manner and the particular illustration provided should not be construed as limiting.

Turning now to a closer study of the tool 30, it will be seen that the tool 30 must necessarily incorporate a shaft 50 which acts to push the twine 16 into the ground 14. Preferably, the shaft 50 has a distal end 52 which incorporates structure configured to engage about the twine 16 in a manner to ensure that the twine 16 is substantially ensnared thereby against misalignment therewith while allowing for release of the twine 16 upon retraction of the tool 30 from within the ground 14.

This is accomplished by providing the distal end 52 with a notch 54 which in the illustrated embodiment rides along the length of twine 16, with its slight degree of tautness.

It will be understood of course that the specific tool 30 illustrated is merely exemplary. For example, the notch 54 could just as easily be a side notch 54 rather than the terminal notch 54 illustrated. Further, the tool 30 may be made operable through manual, hydraulic or electronic activation, with none of these options to be considered outside the scope of the teachings set forth herein.

As previously stated, the soil engaging layer 12 may be one of several known embodiments, such as a geosynthetic layer 12, a lattice layer 12, a biodegradable net layer 12, a metal grid layer 12, etc.

Further, when dealing with geosynthetic material, the layer 12 may be biodegradable as well. At times, once the biodegradable layer 12 has disappeared, it has been desirable to remove traces of the attachment members. When presently available embodiments are used, manual labor is required in digging them up.

With the method of the present invention, a biodegradable twine 16 would be used with a biodegradable layer 12, with both the twine 16 and layer 12 degrading together, and eliminating the need for any further action.

As described above, the method of attaching a geosynthetic or erosion control mat 10 to the underlying ground 14 has a number of advantages, some of which have been enumerated above and others of which are inherent in the invention. Also, modifications may be proposed to the method without departing from the teachings herein. Accordingly, the scope of the invention is only to be limited as necessitated by the accompanying claims.

What is claimed is:

1. A method for fixing a mat for controlling soil erosion including a soil engaging layer to underlying ground, the method comprising the steps of:

feeding a length of twine out over the soil engaging layer of the mat;

pressing a loop of the twine into the ground with a tool through the soil engaging layer at intermittent points along the layer; and retracting the tool.

2. The method of claim 1 wherein the length of twine is continuous at least between adjacent intermittent points.

3. The method of claim 1 wherein the twine is made of a biodegradable material.

4. The method of claim 1 wherein the twine is made of a non-biodegradable material.

5. The method of claim 1 wherein the twine is pressed into the ground using a tool configured to incorporate a notch therein which releasably engages over the twine.

6. The method of claim 1 further including the step of compressing the ground over the loop of twine pressed thereinto.

7. The method of claim 1 wherein the twine is fed over the mat is a predefined pattern.

8. The method of claim 1 wherein the steps are performed manually.

9. The method of claim 1 wherein the steps are performed mechanically.

10. The method of claim 1 wherein the soil engaging layer is a geosynthetic layer.

11. The method of claim 1 wherein the soil engaging layer is a plastic criss cross lattice.

12. The method of claim 1 wherein the soil engaging layer is a metal grid layer.

13. The method of claim 1 wherein the soil engaging layer is biodegradable.

14. The method of claim 1 wherein the soil engaging layer is not biodegradable.

15. A method for fixing a mat for controlling erosion including a soil engaging layer to underlying ground, the method comprising the steps of:

feeding a length of twine out over the soil engaging layer of the mat;

pressing a loop of the twine into the ground with a tool through the soil engaging layer at intermittent points along the layer; retracting the tool and compressing the ground over the loop of twine.

* * * * *